US010883211B2

(12) United States Patent
Choi et al.

(10) Patent No.: US 10,883,211 B2
(45) Date of Patent: Jan. 5, 2021

(54) SEWING MACHINE FOR STITCHING COMPOSITE MATERIALS

(71) Applicant: INDUSTRY-ACADEMIC COOPERATION FOUNDATION GYEONGSANG NATIONAL UNIVERSITY, Jinju-si (KR)

(72) Inventors: Jin Ho Choi, Jinju-si (KR); Jin Hwe Kweon, Jinju-si (KR)

(73) Assignee: Industry-Academic Cooperation Foundation Gyeongsang National University, Jinju-si (KR)

( * ) Notice: Subject to any disclaimer, the term of this patent is extended or adjusted under 35 U.S.C. 154(b) by 276 days.

(21) Appl. No.: 16/066,463

(22) PCT Filed: Dec. 30, 2016

(86) PCT No.: PCT/KR2016/015552
§ 371 (c)(1),
(2) Date: Jun. 27, 2018

(87) PCT Pub. No.: WO2017/116202
PCT Pub. Date: Jul. 6, 2017

(65) Prior Publication Data

US 2019/0010644 A1 Jan. 10, 2019

(30) Foreign Application Priority Data

Dec. 31, 2015 (KR) ..... 10-2015-0191306

(51) Int. Cl.

| | |
|---|---|
| ***D05B 65/00*** | (2006.01) |
| ***D05B 47/04*** | (2006.01) |
| ***D05B 1/02*** | (2006.01) |
| ***D05B 65/02*** | (2006.01) |
| ***D05B 27/00*** | (2006.01) |
| ***D05B 3/12*** | (2006.01) |
| ***D05B 39/00*** | (2006.01) |
| ***D05B 69/08*** | (2006.01) |
| ***D05B 85/10*** | (2006.01) |

(52) U.S. Cl.
CPC ..... *D05B 47/04* (2013.01); *D05B 1/02* (2013.01); *D05B 3/12* (2013.01); *D05B 27/00* (2013.01);
(Continued)

(58) Field of Classification Search
CPC ..... D05B 65/00; D05B 3/12; D05B 27/02; D05B 69/00; D05B 85/10; D05B 47/04; B32B 5/06; Y10T 428/249923
See application file for complete search history.

(56) References Cited

U.S. PATENT DOCUMENTS 4,048,930 A 9/1977 Card
4,187,793 A * 2/1980 Fietta ..... D05B 65/06 112/288
(Continued)

FOREIGN PATENT DOCUMENTS

CN 201089833 Y 7/2008
JP 7-109055 B2 11/1995
(Continued)

OTHER PUBLICATIONS

Office Action, Korean Patent Application No. 10-2015-0191306, dated Apr. 3, 2017, 3 pp.
(Continued)

*Primary Examiner* — Tajash D Patel
(74) *Attorney, Agent, or Firm* — Myers Bigel, P.A.

(57) ABSTRACT

The present invention relates to a structure for fastening composite structures, and more particularly, to a sewing machine for stitching composite materials which is capable of automatically and continuously stitching the composite structures by using a high-rigidity fiber in order to laminate and join the composite materials. The sewing machine for stitching composite materials according to the present invention automatically and continuously performs a stitching
(Continued)

operation for joining composite materials by using a high-rigidity composite fiber for joining the composite materials, and as a result, it is possible to reduce process time for joining the composite materials and improve productivity.

8 Claims, 8 Drawing Sheets

(52) U.S. Cl.
CPC ..... *D05B 39/00* (2013.01); *D05B 65/00* (2013.01); *D05B 65/02* (2013.01); *D05B 69/08* (2013.01); *D05B 85/10* (2013.01); *D05D 2207/04* (2013.01)

(56) References Cited

U.S. PATENT DOCUMENTS 4,453,481 A * 6/1984 Garnett ..... D05B 65/00 112/288
4,991,523 A * 2/1991 Ingram ..... D05C 15/18 112/80.05
5,062,374 A * 11/1991 Wokeck ..... D05B 37/08 112/130
5,165,352 A 11/1992 Ingram
7,217,453 B2 * 5/2007 Johnson ..... B29C 70/086 428/292.1
2002/0020332 A1 2/2002 Hartsell, Jr.

FOREIGN PATENT DOCUMENTS

JP 2013-946 A 1/2013
KR 10-0443144 B1 7/2004
KR 10-2012-0064006 A 6/2012
KR 10-2013-0112774 A 10/2013

OTHER PUBLICATIONS

International Search Report with English-language translation, International Application No. PCT/KR2016/015552, dated Apr. 4, 2017, 5 pp.
Written Opinion of the International Searching Authority, International Application No. PCT/KR2016/015552, dated Apr. 4, 2017, 3 pp.

* cited by examiner

[Figure 1]
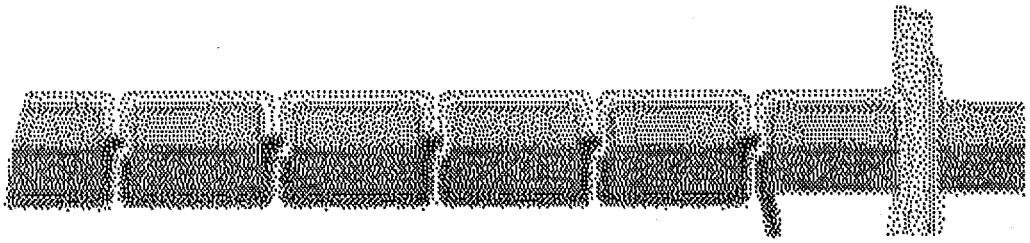
[Figure 2]
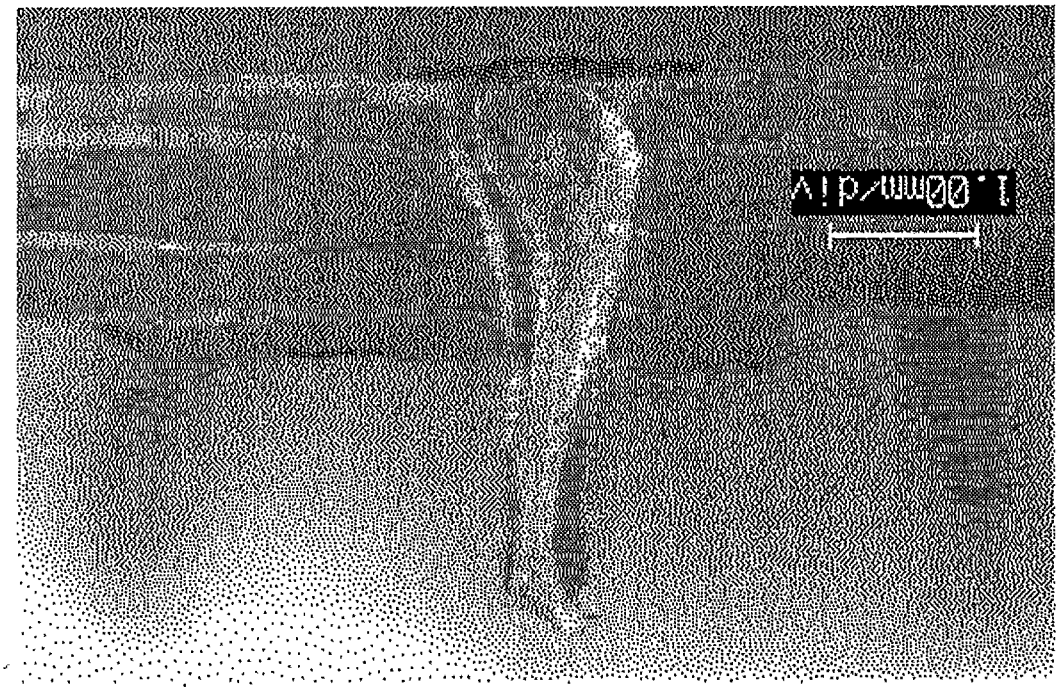

[Figure 3]
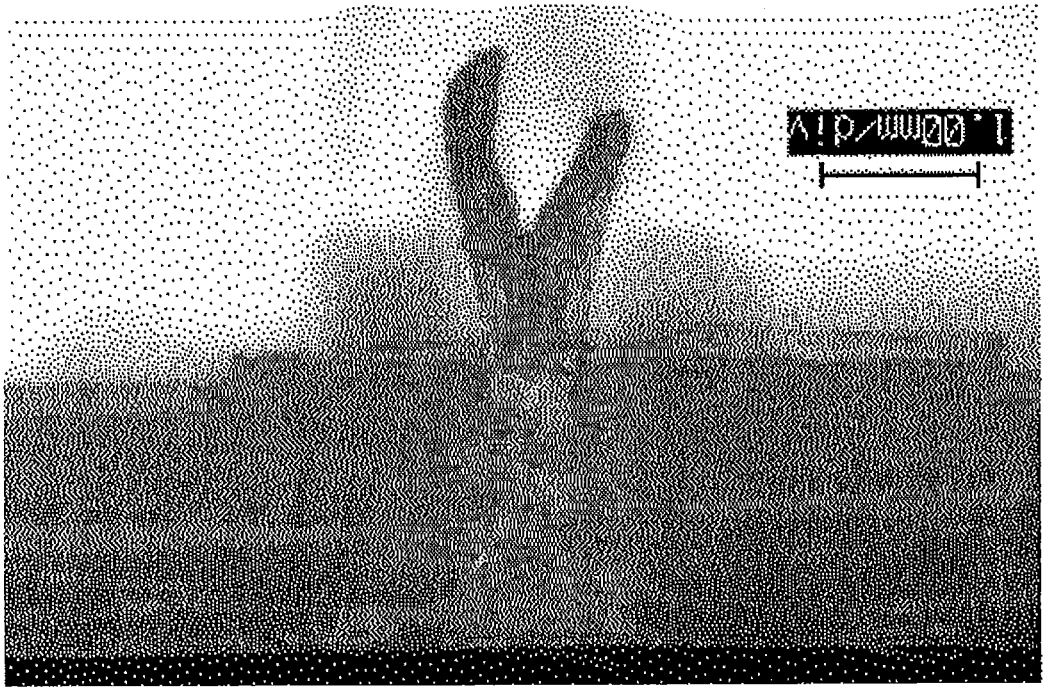

[Figure 4]
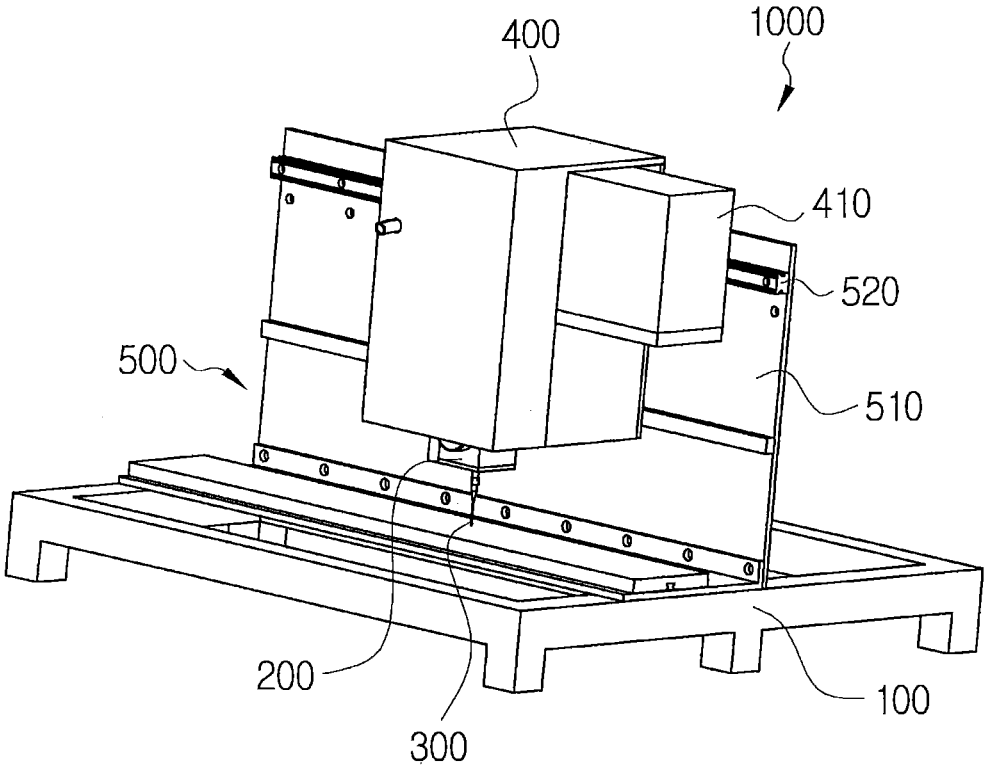

[Figure 5]
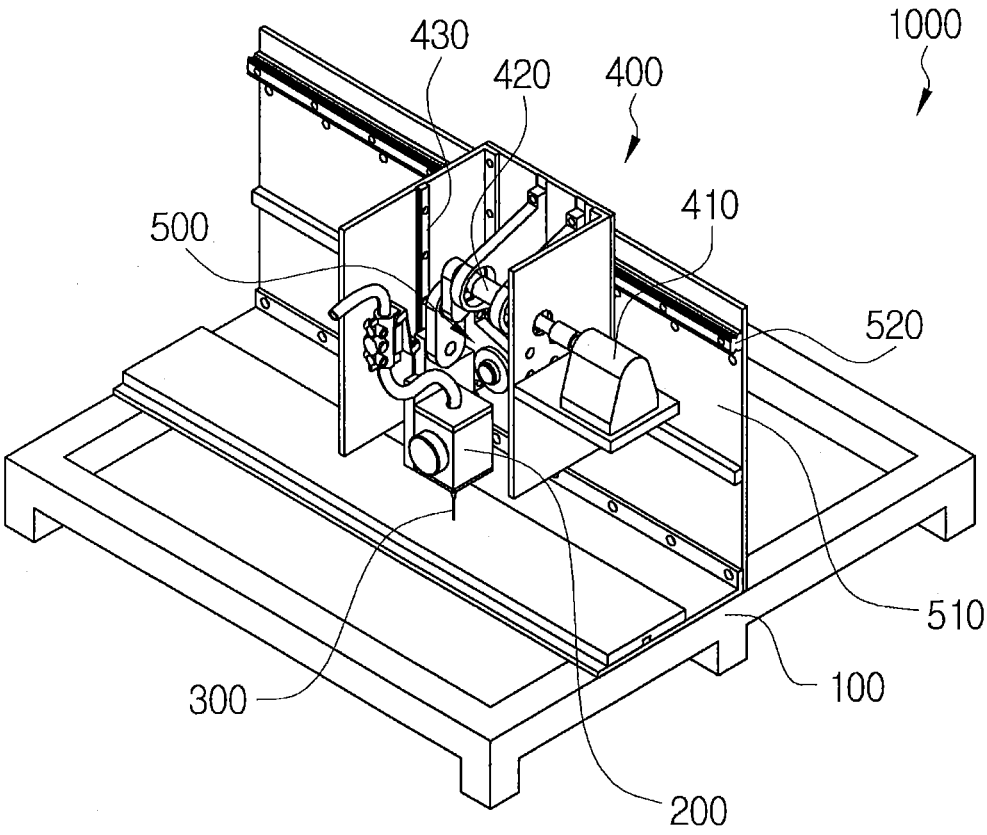

[Figure 6]
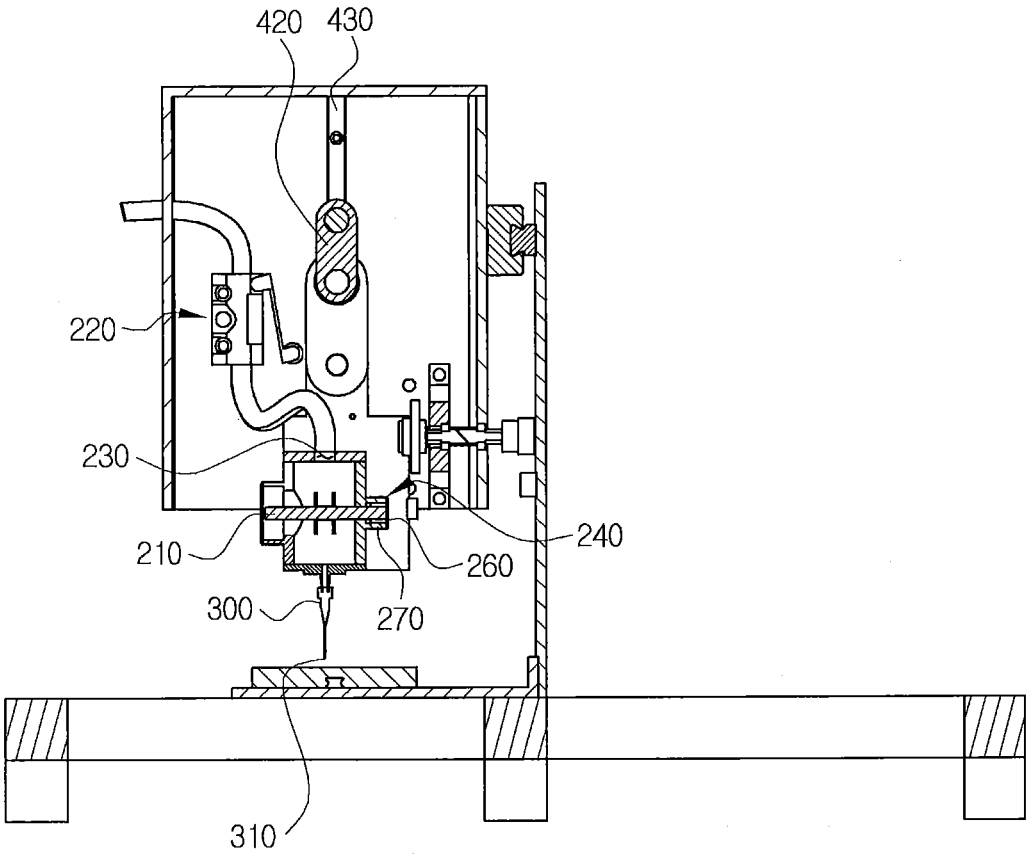
[Figure 7]
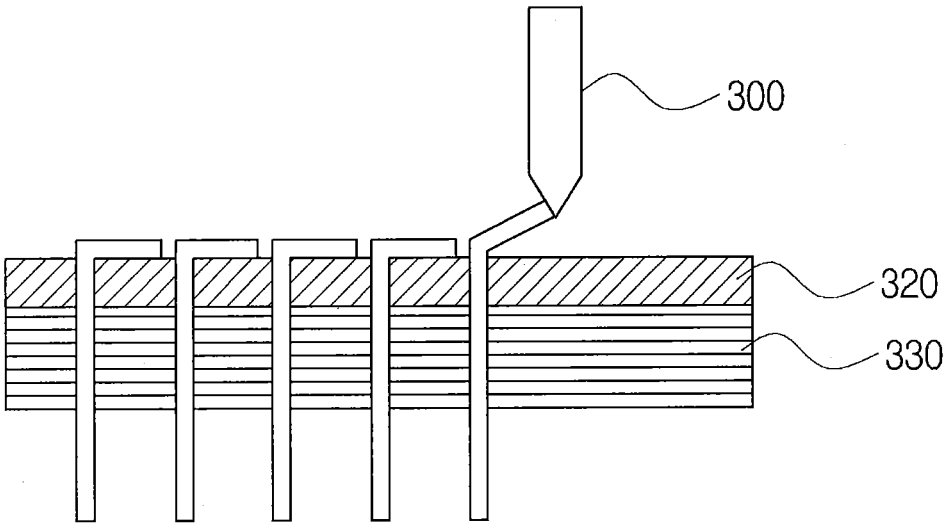

[Figure 8]
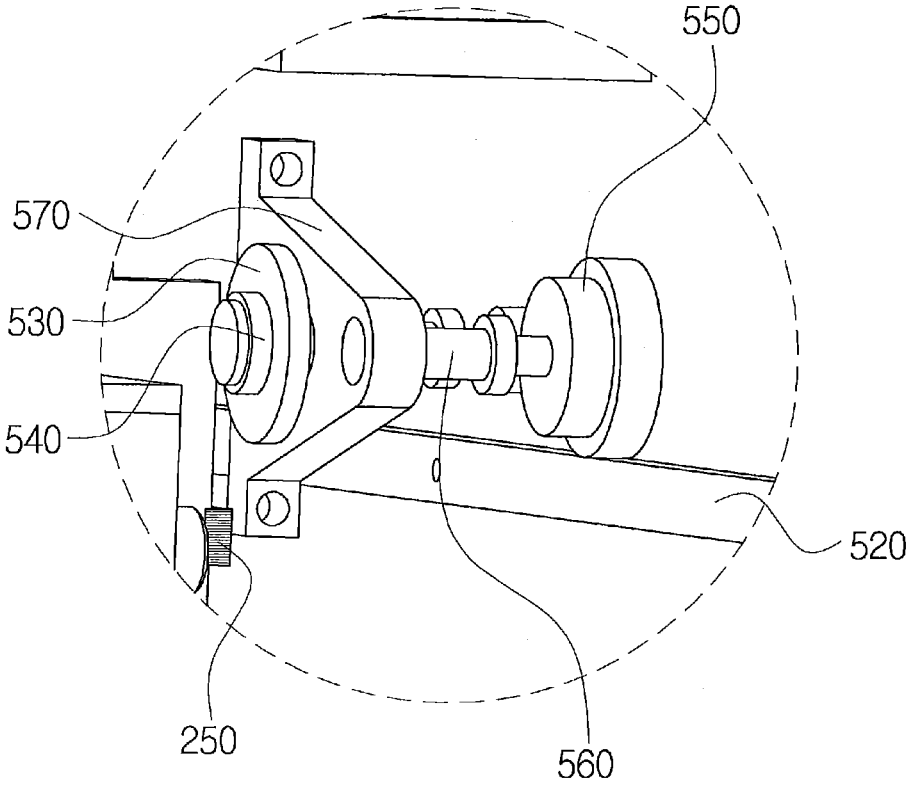

[Figure 9]
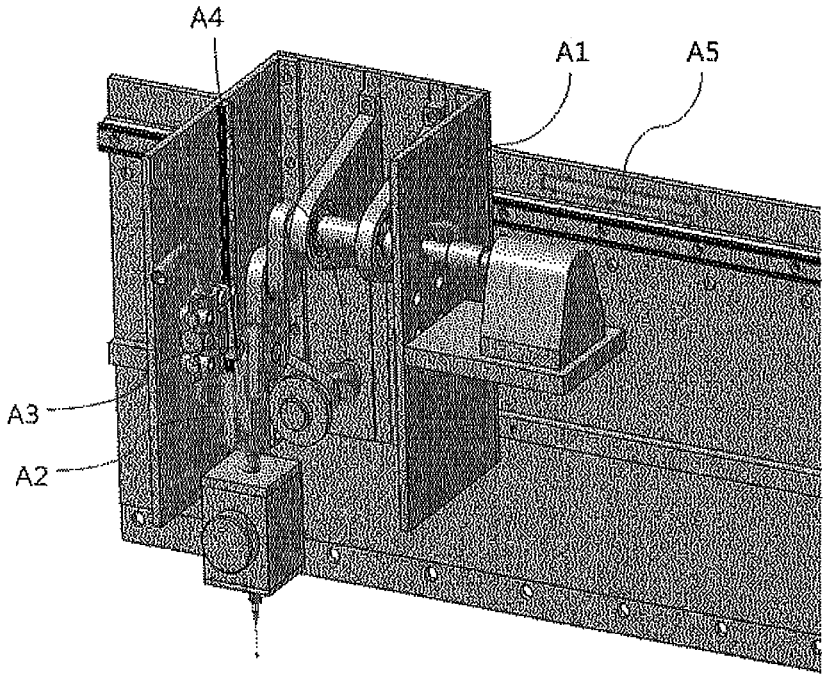

[Figure 10]
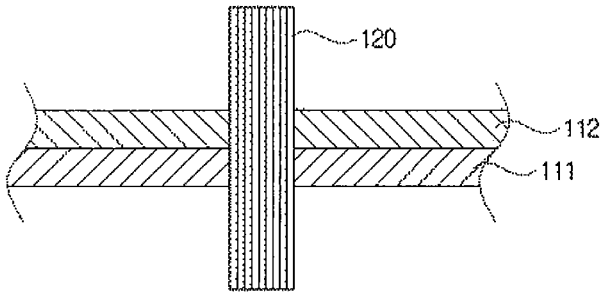
(a)
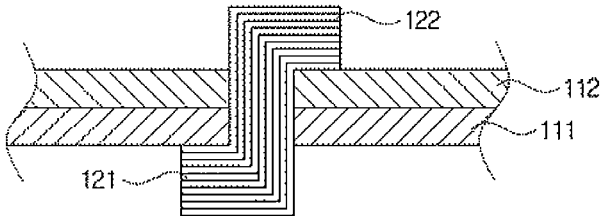
(b)

SEWING MACHINE FOR STITCHING COMPOSITE MATERIALS

TECHNICAL FIELD

The present invention relates to a structure for fastening composite structures, and more particularly, to a sewing machine for stitching composite materials which is capable of automatically and continuously stitching the composite structures by using a high-rigidity fiber in order to laminate and join the composite materials.

BACKGROUND ART

The most typical method of manufacturing high-performance polymeric composite materials is a forming method that cuts prepreg into pieces of prepreg having predetermined sizes, laminates the pieces of prepreg, and then heats and cures the pieces of prepreg in an autoclave under a vacuum condition. However, an interlayer separation in which layers are separated from one another easily occurs in these simply laminated composite materials due to impact in use.

The most effective method of inhibiting the interlayer separation is to use a three-dimensional fiber arrangement structure through fiber reinforcement in a thickness direction. In general, the structure in the thickness direction may be obtained by three-dimensional weaving, and as a representative technology, there are braiding, weaving, Z-pinning, stitching, and the like.

The three-dimensional braiding or weaving process has a limitation in terms of a size of a product that may be manufactured and requires a large amount of time to manufacture a product, and as a result, the three-dimensional braiding or weaving process is not much used except a special product.

The Z-pinning technology refers to a method that forms a laminated composite structure after inserting metal pins or cured composite pins into the multiple laminated composite structure, and the Z-pinning technology slightly increases physical properties of the composite materials in a z-direction, but has a problem in that a large amount of time and effort is required to insert the metal pins or the cured composite pins.

In addition, the stitching technology refers to a method that binds all several sheets of laminated fabrics by penetrating the fabrics with a needle in a thickness direction, and the stitching technology is advantageous in that there is no great limitation in terms of a size of a product and very high productivity is exhibited, whereas the stitching technology has problems in that fibers are damaged due to the penetration of the needle and incomplete resin impregnation may occur when forming the composite materials.

FIG. 1 is a cross-sectional view illustrating a stitching method in the related art. As illustrated in FIG. 1, the existing stitching method makes a structure in which an upper thread (yellow) and a lower thread (green) are continuously twisted and thus connected, and for this reason, there is a problem in that because the upper thread and the lower thread are bent at an angle of 180 degrees, only the soft fiber may be stitched. In the case of the composite materials, polymer based fibers, such as aramid fibers, having excellent flexibility are mainly used for the stitching, but high-rigidity and high-strength carbon fibers cannot exhibit sufficient strength because the stitched fibers are damaged during the stitching process or during use of the stitched fibers. Therefore, there is an increasing need for a sewing machine capable of stitching a high-rigidity and high-strength carbon fiber onto a composite material in order to improve the physical properties of the composite material in the z-direction.

In particular, because the strength in the z-direction (laminated direction) is weakened when laminating and joining pieces of prepreg, there is a need for development on a sewing machine for stitching composite materials which adopts a stitching structure that improves the strength in the z-direction and is easily manufactured.

DOCUMENT OF RELATED ART

Patent Document

Japanese Patent Application Laid-Open No. 2013-000946 (published on Jan. 7, 2013)

DISCLOSURE

Technical Problem

The present invention has been contrived to solve the aforementioned problems, and an object of the present invention is to provide a sewing machine for stitching composite materials, which adopts a composite materials stitching structure which is reinforced with a z-direction fiber and in which a high-strength single fiber having a predetermined length is penetratively disposed in a laminated direction of a composite materials laminated body in which multiple composite materials are laminated, an end of the fiber protrudes to the outside of the composite structure, and the protruding end is arranged and bent at 90 degrees or less in a plane direction of the composite material, thereby joining multiple composite materials laminated structures.

In addition, another object of the present invention is to provide a sewing machine for stitching composite materials which is capable of automatically and continuously stitching the composite materials stitching structures.

Technical Solution

A sewing machine for stitching composite materials according to the present invention may include: a stitching needle having a hollow interior which is connected to a fiber storage reel to be supplied with the fiber and extend the fiber to the other end by pneumatic pressure; a stitching head unit which allows a vertical conveying head unit including the stitching needle to reciprocate upwards and downwards to stitch a joint portion of a stitching object; and a fiber cutting unit which cuts an upper end of the stitched fiber after each stitching is performed.

Here, the sewing machine for stitching composite materials may further include a horizontal conveying unit which is movable in a horizontal direction by a stitching interval when a reciprocal upward and downward movement of the stitching needle is made. In addition, the vertical conveying head unit may supply the fiber to the stitching needle by using pneumatic pressure, and may include a pneumatic pressure adjusting unit and a tension adjusting unit which adjusts a pneumatic pressure to adjust a tension and length of the supplied fiber.

In this case, the tension adjusting unit may include: a friction member which is disposed at one end of the fiber storage reel around which the fiber is wound; and a friction adjusting means which adjusts frictional force between the fiber storage reel and the friction member.

In addition, the stitching head unit may include: a motor; a link which connects the motor and the vertical conveying head unit to allow the vertical conveying head unit to reciprocate upward and downward by the rotation of the motor; and a vertical conveying rail which engages with the vertical conveying head unit to guide the vertical movement of the vertical conveying head unit.

In addition, the horizontal conveying unit may include: a driving wheel which is connected to a head rail of the vertical conveying head unit to horizontally move the stitching head unit by using the upwards movement of the vertical conveying head unit as a driving force; a one-way bearing which is connected to the driving wheel so that the driving wheel rotates only in one direction and transmits rotational force to the driving wheel; and a conveying wheel which is connected to the driving wheel to rotate in conjunction with the rotation of the driving wheel.

As another exemplary embodiment, the horizontal conveying unit may include: a driving wheel which is connected to a head rail of the vertical conveying head unit to horizontally move a lower conveying plate for fixing stitching object by using the upward movement of the vertical conveying head unit as a driving force; a one-way bearing which is connected to the driving wheel so that the driving wheel rotates only in one direction and transmits rotational force to the driving wheel; and a conveying wheel which is connected to the driving wheel to rotate in conjunction with the rotation of the driving wheel.

Further, the fiber cutting unit may include: a blade which is formed at the other end of the needle so that the fiber extended to the outside of the stitching needle is cut at the other end of the needle when the stitching head unit penetrates a joint portion adjacent to the joint portion; and a flexible sheet which is disposed on the stitching object to be cut by friction shearing force when the fiber is cut by the blade.

Advantageous Effects

The sewing machine for stitching composite materials according to the present invention, which is configured as described above, automatically and continuously performs a stitching operation for joining composite materials by using a high-rigidity composite fiber for joining the composite materials, and as a result, it is possible to reduce process time for joining the composite materials and improve productivity.

In addition, according to the composite materials stitching structure made by using the sewing machine of the present invention, it is possible to minimize damage to the stitching fiber and innovatively improve physical properties of the composite structure in the z-direction (laminated direction).

DESCRIPTION OF DRAWINGS

FIG. 1 is a cross-sectional view of a stitching structure in the related art.

FIG. 2 is a photograph of a fiber stitched so that the fiber is bent at 180 degrees or more.

FIG. 3 is a photograph illustrating a state in which the stitched fiber is damaged due to a z-direction load.

FIG. 4 is a perspective view of a sewing machine for stitching composite materials according to a first exemplary embodiment of the present invention.

FIG. 5 is a perspective view of a sewing machine for stitching composite materials according to a second exemplary embodiment of the present invention.

FIG. 6 is an enlarged perspective view of a stitching head unit, a vertical conveying head unit, and a stitching needle according to the exemplary embodiment of the present invention.

FIG. 7 is a cross-sectional view illustrating a stitching process of the sewing machine according to the exemplary embodiment of the present invention.

FIG. 8 is an enlarged perspective view of a horizontal conveying unit according to the second exemplary embodiment of the present invention.

FIG. 9 is a perspective view illustrating a stitching process of the sewing machine for stitching composite materials according to the exemplary embodiment of the present invention.

FIG. 10 is a process diagram illustrating a method of stitching composite materials by using the sewing machine for stitching composite materials according to the present invention.

DESCRIPTION OF MAIN REFERENCE NUMERALS OF DRAWINGS

1000: Sewing machine for stitching composite materials
100: Working stage
200: Vertical conveying head unit
210: Fiber storage reel
220: Pneumatic pressure adjusting unit
230: Pneumatic pressure supplying unit
240: Tension adjusting unit
250: Head rail
260: Friction plate
270: Bolt-nut
300: Stitching needle
310: Blade
320: Flexible sheet
330: Stitching object
400: Stitching head unit
410: Motor
420: Link unit
430: Vertical conveying rail
500: Horizontal conveying unit
510: Horizontal conveying stage
520: Horizontal conveying rail
530: Driving wheel
540: One-way bearing
550: Conveying wheel
560: connecting shaft
570: Fixing bracket

BEST MODE

FIG. 1 illustrates the existing stitching structure in which the upper thread (yellow) and the lower thread (green) are continuously twisted so that the fiber is bent at 180 degrees or more, FIG. 2 illustrates a photograph of a stitched fiber which is bent at 180 degrees or more, and it can be seen that as illustrated in FIG. 3, a portion, which is bent at 180 degrees, is easily damaged when a load is applied to a composite material in a z-direction.

That is, because the existing stitching structure is a structure in which the fiber is inevitably bent at 180 degrees or more, the stitching structure has weakened strength when a z-direction load is applied, such that the stitching structure is very likely to be damaged or broken, and as a result, there is a problem in that it is impossible to apply a high-strength fiber such as a carbon fiber in order to reinforce strength.

A sewing machine for stitching composite materials according to the present invention, which serves to implement a composite stitching structure reinforced with a z-direction fiber in order to solve the aforementioned problems, will be described in detail with reference to the drawings.

FIG. 4 is an entire perspective view illustrating a sewing machine 1000 for stitching composite materials (hereinafter, referred to as a sewing machine) according to a first exemplary embodiment of the present invention, and FIG. 5 is a projection perspective view illustrating a sewing machine 1000 according to a second exemplary embodiment of the present invention.

There is a difference in that the sewing machine 1000 according to the first exemplary embodiment of the present invention is structured so that a horizontal conveying unit 500 stitches a stitching object while horizontally moving the stitching object and the sewing machine 1000 according to the second exemplary embodiment is structured so that a horizontal conveying unit 500 stitches a stitching object while horizontally moving a stitching head unit 400, and the other configurations of the sewing machines are similar to each other.

As illustrated, the sewing machine 1000 includes a working stage 100, a vertical conveying head unit 200, a stitching needle 300, the stitching head unit 400, and the horizontal conveying unit 500.

The respective configurations of the sewing machine 1000 are mounted on the working stage 100, and the working stage 100 may have a configuration of a typical working stage installed on a bottom floor.

A fiber is wound and stored inside the vertical conveying head unit 200, and the vertical conveying head unit 200 serves to supply the fiber to the stitching needle 300 by using pneumatic pressure. The vertical conveying head unit 200 serves to insert a fiber extending from the stitching needle 300 into a joint portion of the stitching object in a state in which the stitching needle 300 penetrates the joint portion. In addition, the vertical conveying head unit 200 also serves to cut an upper end of the fiber inserted into the joint portion when the fiber penetrates the adjacent joint portion. A detailed configuration of the vertical conveying head unit 200 will be described below with reference to FIG. 6.

The stitching head unit 400 is configured to move the vertical conveying head unit 200 downward to allow the stitching needle 300 to penetrate the joint portion, and to move the vertical conveying head unit 200 upward to allow the stitching needle 300 to be separated from the joint portion. That is, the stitching needle 300 reciprocates upward and downward by the stitching head unit 400, thereby stitching the stitching object. To perform this operation, the stitching head unit 400 includes a motor 410, a link unit 420 which connects the motor 410 and the vertical conveying head unit 200, and a vertical conveying rail 430 which engages with the vertical conveying head unit 200 and guides the upward and downward reciprocating movements of the vertical conveying head unit 200. Therefore, the link unit 420 of the stitching head unit 400 is operated by the rotation of the motor 410, and the stitching head unit 200 reciprocates upward and downward by the operation of the link unit 420 and the operation of the vertical conveying rail 430.

As illustrated in FIG. 4, the horizontal conveying unit 500 according to the first exemplary embodiment of the present invention is configured to horizontally move a lower conveying plate on which the stitching object is mounted, and the horizontal conveying unit 500 is configured such that the stitching needle 300 stitches the joint portion, and then continuously stitches the adjacent joint portion. The horizontal conveying unit 500 cooperates with the vertical conveying head unit 200 to horizontally move the lower conveying plate.

In addition, as illustrated in FIG. 5, a horizontal conveying unit 500 according to a third exemplary embodiment of the present invention is configured to horizontally move a stitching head unit 400, and the horizontal conveying unit 500 is configured such that a stitching needle 300 stitches a joint portion, and then continuously stitches an adjacent joint portion. The horizontal conveying unit 500 cooperates with a vertical conveying head unit 200 to horizontally move the stitching head unit 400. A detailed configuration thereof will be described in detail with reference to FIG. 8.

FIG. 6 is an enlarged perspective view illustrating the vertical conveying head unit 200 and the stitching needle 300 according to the exemplary embodiment of the present invention.

As illustrated, the vertical conveying head unit 200 includes a fiber storage reel 210, a pneumatic pressure adjusting unit 220, a pneumatic pressure supplying unit 230, and a tension adjusting unit 240. The fiber is wound and stored in the fiber storage reel 210, and the fiber storage reel 210 is configured to extend the fiber through the stitching needle 300 by using pneumatic pressure supplied from the pneumatic pressure supplying unit 230. In this case, the fiber in the vertical conveying head unit 200 is configured such that a length of the fiber, which is extended from the stitching needle 300, may be adjusted by adjusting intensity of the pneumatic pressure supplied from the pneumatic pressure supplying unit 230 by using the pneumatic pressure adjusting unit 220, and adjusting tension of the fiber by using the tension adjusting unit 240. The tension adjusting unit includes a friction plate 260 and a bolt-nut 270 that may adjust rotational friction of a shaft of the fiber storage reel 210.

The stitching needle 300 is configured as a needle having a hollow interior so that the fiber is supplied from one end of the stitching needle 300 and extended to the other end of the stitching needle 300 by the vertical conveying head unit 400. In this case, a blade 310 may be formed around the other end of the stitching needle 300 to cut the fiber. The stitching process of the stitching needle 300 will be simply described. The fiber is extended and inserted into the joint portion in a state in which the stitching needle 300 penetrates downward the joint portion of the stitching object, only the stitching needle 300 is moved upward in the state in which the fiber is inserted, and then the fiber is continuously supplied even when the stitching needle 300 is horizontally moved. Next, when the stitching needle 300 penetrates a joint portion adjacent to the joint portion, the upper end of the fiber inserted into the previous joint portion is cut by the blade 310.

FIG. 7 is a cross-sectional view illustrating the exemplary embodiment of the stitching process of the sewing machine 1000. To more easily cut the fiber, the blade 310 is configured such that a flexible friction sheet 320 such as a sheet made of rubber, polyurethane foam, or the like is disposed on a stitching object 330, such that the fiber is cut by shear frictional force between the stitching needle 300 and the flexible friction sheet 320 when the stitching needle 300 penetrates the stitching object 330, and as a result, the fiber is more easily cut by the blade 310.

FIG. 8 is an enlarged perspective view of the horizontal conveying unit 500 according to the second exemplary embodiment of the present invention.

The horizontal conveying unit 500 includes a horizontal conveying stage 510, a horizontal conveying rail 520, a driving wheel 530, a one-way bearing 540, a conveying wheel 550, a connecting shaft 560, and a fixing bracket 570.

The horizontal conveying stage 510 is formed in the form of a plate as a configuration for conveying the stitching head unit 400 in the horizontal direction, and the horizontal conveying stage 510 may be disposed and fixed in a vertical direction on an upper surface of the working stage 100. The horizontal conveying rail 520 for guiding the movement is formed on the horizontal conveying stage 510.

The driving wheel 530 is configured to be rotated in a state in which an outer circumferential surface of the driving wheel 530 is in contact with a head rail of the vertical conveying head unit 200. That is, the driving wheel 530 is configured to be rotated when the vertical conveying head unit 200 is moved upward and downward. In this case, the one-way bearing 540 is provided between the driving wheel 530 and the connecting shaft 560, such that the driving wheel 530 may be rotated only in one direction so that the driving wheel 530 is not rotated when the vertical conveying head unit 200 is moved downward. In addition, the driving wheel 530 may be configured to be rotated by being in contact with the head rail of the vertical conveying head unit 200 only when the stitching needle 300 is separated from the joint portion of the stitching object even though the vertical conveying head unit 200 is rotated upward. The configuration is to stop the horizontal movement of the stitching needle 300 until the stitching needle 300 is separated from the joint portion when the stitching needle 300 penetrates the joint portion, and to move the vertical conveying head unit 200 to the next joint portion through the horizontal movement of the stitching head unit 400 when the joint portion is completely stitched. The conveying wheel 550 may be connected to the driving wheel 530 through the connecting shaft 560 so that the conveying wheel 550 is rotated in conjunction with the rotation of the driving wheel 530. The conveying wheel 550 is configured such that an outer circumferential surface of the conveying wheel 550 engages with the horizontal conveying rail 520, such that the stitching head unit 400 may be horizontally moved by the rotation of the conveying wheel 550.

FIG. 9 is a perspective view illustrating a stitching process of the sewing machine 1000 for stitching composite materials according to the exemplary embodiment of the present invention.

The stitching process will be sequentially described. First, a first operation A1 of operating the rotating shaft of the motor is performed. Next, a second operation A2 is performed as the link unit is operated by the first operation A1, the vertical conveying head unit is rotated downward by the operation of the link unit, and the stitching needle penetrates the joint portion. Next, a third operation A3 is performed as the vertical conveying head unit is rotated upward by the continuous operation of the link unit such that the stitching needle is separated from the joint portion. Next, a fourth operation A4 is performed as the driving wheel and the conveying wheel are operated by the upward rotation of the vertical conveying head unit, and a fifth operation A5 is performed as the vertical conveying head unit is horizontally moved by the fourth operation A4 such that the stitching needle reaches the next joint portion. Next, the stitching needle continuously stitches the stitching object as the second to fifth operations A2 to A5 are repeatedly performed.

Hereinafter, a method of joining the stitching object by using the sewing machine 1000 configured as described above will be described with reference to the drawings.

Referring to FIG. 10, first, a step of penetrating a composite fiber 120 made of a single material on a composite—laminated body 100 by using the sewing machine 1000 is performed. A needle structure in which the composite fiber 120 is continuously supplied may be applied to penetrate the composite fiber 120, and the needle may penetrate the composite laminated body 100 first, and then the composite fiber 120 supplied from the needle may be received on the penetrated composite laminated body 100.

In this case, it is important that one side end 121 and the other side end 122 of the composite fiber 120 are disposed to protrude outward from an outermost periphery of the composite laminated body 100. That is, the one side end 121 of the composite fiber 120 protrudes downward from a lowermost side of the composite fiber 120, and the other side end 122 of the composite fiber 120 protrudes upward from an uppermost side of the composite fiber 120.

Next, a step of bending and fixing the one side end 121 of the composite fiber 120 by pressing one surface of the composite laminated body 100 in a direction toward the other surface of the composite fiber 120, and bending and fixing the other side end 122 of the composite fiber 120 by pressing the other surface of the composite laminated body 100 in a direction toward the one surface of the composite laminated body 100 is performed. The bending and fixing step is simultaneously performed during a process of thermally curing the composite laminated body 100, and performed by cutting the composite fiber 120 into composite fibers having predetermined lengths, thereby discontinuously reinforcing the composite fibers 120.

The technical spirit of the present invention should not be construed as being limited to the aforementioned exemplary embodiments. The present invention may be applied in various fields and may be variously modified by those skilled in the art without departing from the subject matter of the present invention claimed in the claims. Therefore, the alterations and the modifications belong to the protection scope of the present invention as long as the alterations and the modifications are obvious to those skilled in the art.

The invention claimed is:

1. A sewing machine for stitching composite materials, the sewing machine comprising:

a stitching needle having a hollow interior which is connected to a fiber storage reel to be supplied with the fiber and extend the fiber to the other end by pneumatic pressure;

a stitching head unit which allows a vertical conveying head unit including the stitching needle to reciprocate upwards and downwards to stitch a joint portion of a stitching object; and a fiber cutting unit which cuts an upper end of a stitched fiber adjacent to the joint portion of the stitching object after each stitching is performed.

2. The sewing machine of claim 1, further comprising:

a horizontal conveying unit which is movable in a horizontal direction by a stitching interval when a reciprocal upward and downward movement of the stitching needle is made.

3. The sewing machine of claim 1, wherein the vertical conveying head unit supplies the fiber to the stitching needle by pneumatic pressure, and includes a pneumatic pressure adjusting unit and a tension adjusting unit which adjusts the pneumatic pressure to adjust a tension and length of the supplied fiber.

4. The sewing machine of claim 3, wherein the tension adjusting unit includes:

a friction member which is disposed at one end of the fiber storage reel around which the fiber is wound; and a friction adjusting means which adjusts frictional force between the fiber storage reel and the friction member.

5. The sewing machine of claim 1, wherein the stitching head unit includes:

a motor;

a link which connects the motor and the vertical conveying head unit to allow the vertical conveying head unit to reciprocate upward and downward by the rotation of the motor; and a vertical conveying rail which engages with the vertical conveying head unit to guide the vertical movement of the vertical conveying head unit.

6. The sewing machine of claim 2, wherein the horizontal conveying unit includes:

a driving wheel which is connected to a head rail of the vertical conveying head unit to horizontally move the stitching head unit by using the upwards movement of the vertical conveying head unit as a driving force;

a one-way bearing which is connected to the driving wheel so that the driving wheel rotates only in one direction and transmits rotational force to the driving wheel; and a conveying wheel which is connected to the driving wheel to rotate in conjunction with the rotation of the driving wheel.

7. The sewing machine of claim 2, wherein the horizontal conveying unit includes:

a driving wheel which is connected to a head rail of the vertical conveying head unit to horizontally move a lower conveying plate for fixing stitching object by using the upward movement of the vertical conveying head unit as a driving force;

a one-way bearing which is connected to the driving wheel so that the driving wheel rotates only in one direction and transmits rotational force to the driving wheel; and a conveying wheel which is connected to the driving wheel to rotate in conjunction with the rotation of the driving wheel.

8. The sewing machine of claim 1, wherein the fiber cutting unit includes:

a blade which is formed at the other end of the needle so that the fiber extended to the outside of the stitching needle is cut at the other end of the needle when the stitching head unit penetrates a joint portion adjacent to the joint portion; and a flexible sheet which is disposed on the stitching object to be cut by friction shearing force when the fiber is cut by the blade.

* * * * *